US008364053B2

(12) United States Patent
Cho

(10) Patent No.: US 8,364,053 B2
(45) Date of Patent: Jan. 29, 2013

(54) IMAGE FORMING APPARATUS SERVER CONNECTED TO IMAGE FORMING APPARATUS AND PRINT CHARGING METHOD THEREOF

(75) Inventor: Jae-kyung Cho, Suwon-si (KR)

(73) Assignee: Samsung Electronics Co., Ltd., Suwon (KR)

( * ) Notice: Subject to any disclaimer, the term of this patent is extended or adjusted under 35 U.S.C. 154(b) by 322 days.

(21) Appl. No.: 12/801,223

(22) Filed: May 27, 2010

(65) Prior Publication Data

US 2011/0076044 A1 Mar. 31, 2011

(30) Foreign Application Priority Data

Sep. 29, 2009 (KR) ..... 10-2009-0092668

(51) Int. Cl.
*G03G 21/02* (2006.01)

(52) U.S. Cl. ..... 399/79

(58) Field of Classification Search ..... 399/79; 705/14, 400

See application file for complete search history.

(56) References Cited

U.S. PATENT DOCUMENTS 7,127,433 B2 * 10/2006 Baker ..... 705/400
7,464,048 B2 * 12/2008 Ishii et al. ..... 705/14.1
2003/0046171 A1 * 3/2003 Whale ..... 705/26
2003/0115156 A1 * 6/2003 Baker ..... 705/400
2006/0221387 A1 * 10/2006 Swift et al. ..... 358/1.15
2008/0107440 A1 * 5/2008 Tsuzuki ..... 399/79
2009/0073475 A1 * 3/2009 Jones ..... 358/1.12

FOREIGN PATENT DOCUMENTS

JP 2001-034446 2/2001
JP 2007-011945 1/2007

* cited by examiner

*Primary Examiner* — David Gray
*Assistant Examiner* — G. M. Hyder
(74) *Attorney, Agent, or Firm* — Staas & Halsey LLP

(57) ABSTRACT

Disclosed are an image forming apparatus server connected to an image forming apparatus and a print charging method thereof. A print charging method for at least one image forming apparatus, the method including: setting charging standards for a print usage volume of the at least one image forming apparatus; collecting usage volume information of the at least one image forming apparatus according to the set charging standards; and changing the charging standards by using the collected usage volume information and calculating charges by using the changed charging standards. With this, the image forming apparatus server uses the changed CPP reflecting the change to thereby reduce errors in the initial charging standards, actively respond to the changed user environment and win confidence from both a supplier and a user.

20 Claims, 3 Drawing Sheets

IMAGE FORMING APPARATUS SERVER CONNECTED TO IMAGE FORMING APPARATUS AND PRINT CHARGING METHOD THEREOF

CROSS-REFERENCE TO RELATED APPLICATIONS

This application claims priority from Korean Patent Application No. 10-2009-0092668, filed on Sep. 29, 2009, in the Korean Intellectual Property Office, the disclosure of which is incorporated herein by reference.

BACKGROUND

1. Field

Apparatuses and methods consistent with the present embodiment relate to an image forming apparatus server connected to an image forming apparatus and a print charging method thereof, and more particularly, to an image forming apparatus server connected to an image forming apparatus and a print charging method thereof which calculates charges by changing charging standards depending on a print usage volume.

2. Description of the Related Art

An image forming apparatus forms an image on print paper. The image forming apparatus may include a printer, a photocopier, a facsimile, a multi-function device which has at least two functions, etc.

Recently, demand for an image forming apparatus as an office automation device performing not only a document print function but also a scanning function and a faxing function has increased. Accordingly, expensive image forming apparatuses have been developed to extend functions and perform various functions with high performance.

Instead of purchasing such expensive digital multi-function devices, in many cases, people use leased devices.

If a leased digital multi-function device is used, an equipment supplier may determine a usage volume by carrying out a simulation for a predetermined time with respect to a sampling group before executing a lease agreement, and may execute the lease agreement according to charging standards in consideration of a user's print volume and an agreement term. The charges are imposed in a lump sum according to fixed charging standards.

However, such determination of charging standards after performance of the simulation may take at least one month and require high expenses. Thus, it is hard to perform the determination frequently.

While the usage volume at the time of the execution of the lease agreement is reflected in the charging standards, it may cause loss to either a supplier or a user depending on variables of user environments, such as the special nature of the user's annual work volume, an increase or decrease in the number of users due to frequent change in organizations and a difference of usage volume between the sampling group and the actual user group.

SUMMARY

Accordingly, it is an aspect of the present embodiment to provide an image forming apparatus server connected to an image forming apparatus and a print charging method thereof which collects a user's print usage volume at predetermined intervals and calculates charges by changing charging standards depending on the collected usage volume information to thereby reduce errors in initial charging standards and win confidence from both a supplier and a user.

Additional aspects and/or advantages will be set forth in part in the description which follows and, in part, will be obvious from the description, or may be learned by practice of the present invention.

The foregoing and/or other aspects are also achieved by providing a print charging method for at least one image forming apparatus, the method including: setting charging standards for the at least one image forming apparatus; collecting usage volume information of the at least one image forming apparatus according to the set charging standards; and changing the charging standards by using the collected usage volume information and calculating charges by using the changed charging standards.

The method may further include determining whether to change the charging standards by using the collected usage volume information.

The charging standards may include a charging period, and the collecting the usage volume information may include collecting usage volume information during the set charging period.

The charging standards may further include a cost per page (CPP) and change requirements for the CPP.

An initial value of the CPP may be set according to at least one of equipment costs, a lease period, a charging period, an estimated usage volume, supplies expenses, a discount rate and service charges.

The calculating the charges may include calculating the charges by using the usage volume information during the set charging period and the CPP.

The determining whether to change the charging standards may include determining whether to change the charging standards by using a change rate of a usage volume collected during a predetermined charging period with respect to a usage volume collected during a previous charging period.

The determining whether to change the charging standards may further include comparing the change rate and a predetermined reference value, and determining whether to change the charging standards according to the comparison result.

The calculating the charges may include calculating the charges by increasing or decreasing the CPP corresponding to the change rate.

When the change rate is greater than a first reference change rate or less than a second reference change rate, the CPP is not increased or decreased corresponding to the change rate and the CPP is reset.

The method may further include storing a table including the CPP corresponding to the change rate, wherein the calculating the charges may include calculating the charges by using the stored CPP corresponding to the change rate.

The calculating the charges may include changing the CPP to have the usage volume during the predetermined charging period correspond to the usage volume during the previous charging period.

The foregoing and/or other aspects are achieved by providing an image forming apparatus server connected to at least one image forming apparatus, the image forming apparatus server including: a user input unit to set charging standards for a print usage volume of the at least one image forming apparatus; a communication unit to collect usage volume information of the at least one image forming apparatus; a storage unit to store therein the collected usage volume information; and a controller to control the communication unit to collect the usage volume information according to the set charging standards and to change the charging standards by using the stored usage volume information and calculate charges by using the changed charging standards.

The controller may further determine whether to change the charging standards by using the stored usage volume information.

The charging standards may include a charging period, and the communication unit may collect the usage volume information during the set charging period.

The charging standards may further include a cost per page (CPP) and change requirements for the CPP.

An initial value of the CPP may be set according to at least one of an equipment cost, a lease period, a charging period, an estimated usage volume, supplies expenses, a discount rate and service charges.

The controller may calculate the charges by using the usage volume information during the set charging period and the CPP.

The controller may determine whether to change the charging standards by using a change rate of a usage volume collected during a predetermined charging period with respect to a usage volume collected during a previous charging period.

The controller may compare the change rate and a predetermined reference value and determine whether to change the charging standards according to the comparison result.

The controller may calculate the charges by increasing or decreasing the CPP corresponding to the change rate.

The storage unit may further store therein a table including the CPP corresponding to the change rate, and the controller may calculate the charges by using the CPP corresponding to the change rate.

BRIEF DESCRIPTION OF THE DRAWINGS

The above and/or other aspects will become apparent and more readily appreciated from the following description of the embodiments, taken in conjunction with the accompanying drawings of which.

DETAILED DESCRIPTION

Hereinafter, at least one exemplary embodiment will be described with reference to accompanying drawings, wherein like numerals refer to like elements and repetitive descriptions will be avoided as necessary.

Figure 1:
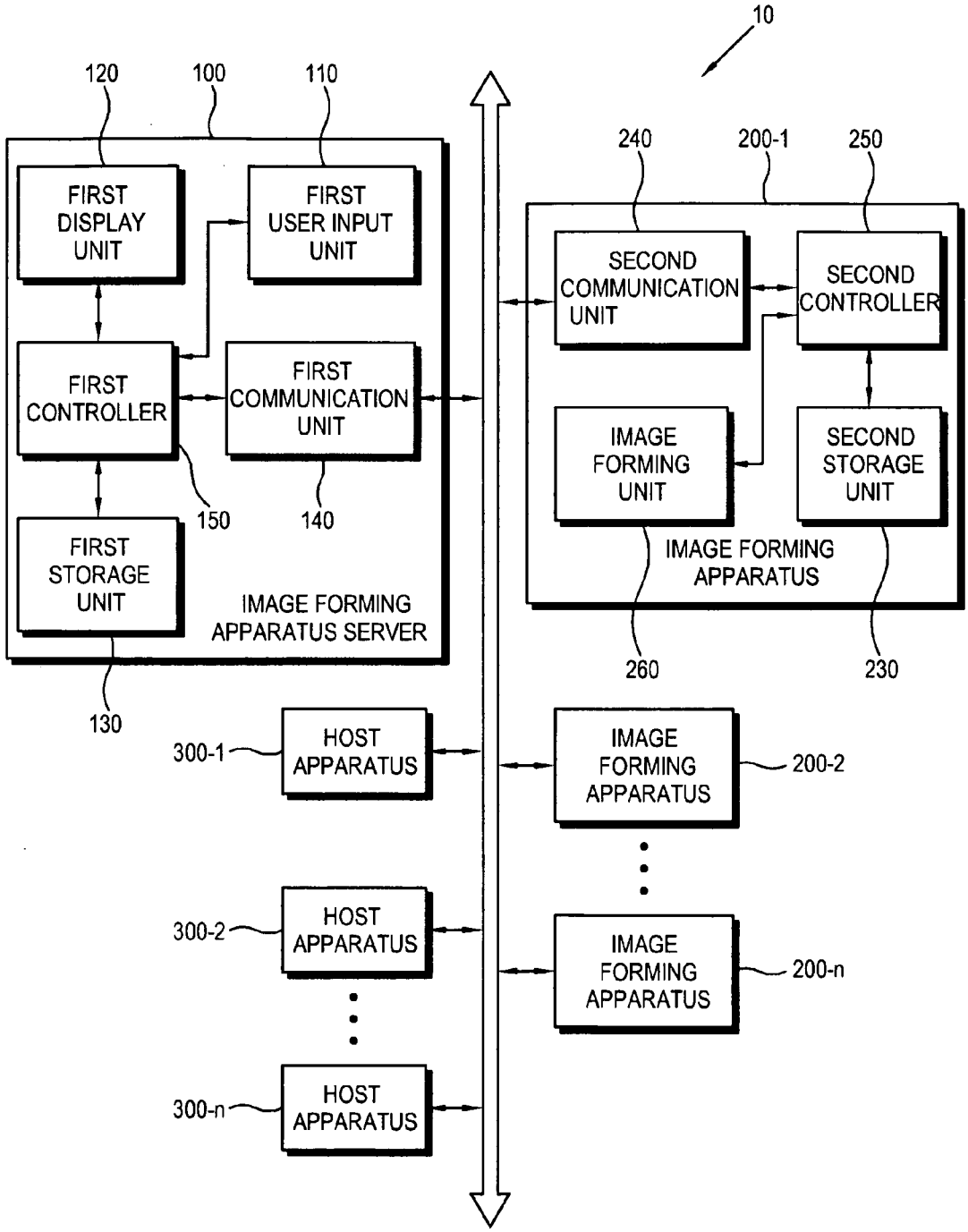
FIG. 1 is a block diagram of an image forming apparatus server, an image forming apparatus, a host apparatus and a printing system including the same according to an exemplary embodiment.

FIG. 1 is a block diagram of a printing system 10 including an image forming apparatus server 100, an image forming apparatus 200 and a host apparatus 300 according to an exemplary embodiment.

As shown therein, the printing system 10 according to the present embodiment includes the image forming apparatus server 100, at least one of image forming apparatuses 200-1, 200-2, . . . , and **200-*n*, and at least one of host apparatuses 300-1, 300-2, . . . and 300-*n***.

The printing system 10 according to the present embodiment may separately include the image forming apparatus server 100 or may have a host apparatus 300-1 perform functions as the image forming apparatus server 100. If the host apparatus 300-1 performs functions of the image forming apparatus server 100, the image forming apparatus server 100 may be included in the host apparatus 300-1.

The image forming apparatus server 100 is connected to at least one of the image forming apparatuses 200-1, 200-2, . . . , and **200-*n* to collect usage volume information from at least one of the image forming apparatuses 200-1, 200-2, . . . , and 200-*n***.

The image forming apparatuses 200-1, 200-2, . . . , and **200-*n* according to the present embodiment may be shared as a network image forming apparatus, the image forming apparatuses 200-1, 200-2, . . . , and 200-*n*** having their own IP addresses assigned in a network.

The network image forming apparatus is connected to at least one of the host apparatuses 300-1, 300-2, . . . , and **300-*n*** through a communication network.

The host apparatuses 300-1, 300-2, . . . , and **300-*n* include a personal computer (PC), while the image forming apparatuses 200-1, 200-2, . . . , and 200-*n* may include a printer or a multi-function device performing at least two functions and connected in a network, by a local connection, in parallel or by UNC and include an image forming unit 260** performing a print operation according to a print command.

Here, the print operation includes a print operation to copy a scanned document, a print operation for received fax data and a print operation for print data received from the outside through the host apparatuses 300-1, 300-2, . . . , and **300-*n* including a server or print data stored in an inside (hard disk drive) or outside (USB memory stick) of the image forming apparatuses 200-1, 200-2, . . . and 200-*n***.

According to an exemplary embodiment, the image forming apparatus server 100 has a charges calculation program installed as software collecting usage volume information of at least one of the image forming apparatuses 200-1, 200-2, . . . and **200-*n* and calculating charges according to a predetermined algorithm based on the collected usage volume information. The charges calculation program may be included in a printer driver, and may include various applications and solutions to enhance functions of the image forming apparatuses 200-1, 200-2, . . . and 200-*n* depending on the type of the image forming apparatuses 200-1, 200-2, . . . and 200-*n***.

The image forming apparatus server 100 which has the charges calculation program installed therein according to the present embodiment may be used in the enterprise business, which pays charges by usage period according to print usage volume rather than by purchases devices.

As shown therein, the image forming apparatus server 100 includes a first user input unit 110, a first display unit 120, a first storage unit 130, a first communication unit 140 and a first controller 150.

If a host apparatus performs functions of the image forming apparatus server 100, the image forming apparatus server 100 may further include an image processor (not shown) which generates print data in a predetermined print language according to a print command.

The first user input unit 110 sets charging standards for a print usage volume of at least one of the image forming apparatuses 200-1, 200-2, . . . and **200-*n***. The set charging standards may include a charging period, a cost per page (CPP) and changing standards for the CPP.

An equipment supplier, i.e., an administrator, may set an initial value of the CPP in consideration of equipment cost, a lease period, a charging period, an estimated usage volume, supplies expenses, a discount rate and service charges.

The lease period may be one or more year and the charging period may be set at an interval of one week, four weeks or one month, for example, at which a user pays the rent to the supplier.

The estimated usage volume and the supplies expenses may be determined by a simulation of a predetermined sampling group before an execution of a lease agreement. The simulation period is optional, such as one week, one month, etc.

An administrator determines the estimated usage volume and the supplies expenses in consideration of the number of users, including the number of printed sheets of paper and supplies expenses, such as toner and paper.

The discount rate and the service charges may be set under an agreement between an administrator and a user. If the print usage volume is large according to the simulation result and the lease period is long, an administrator may provide a higher discount rate and impose lower service charges.

If the print usage volume is estimated to be high and the lease period is long, the CPP may be low.

The change requirements for the CPP may be determined under the agreement between an administrator and a user.

If the usage volume sharply increases or decreases or a department relocation occurs, the CPP may be changed.

The first user input unit 110 may include a keyboard and a mouse, for example, provided as an input device of the image forming apparatus server 100, and a graphic user interface (hereinafter, to be called UI) which is generated by an execution of a driver or an additional application and displayed on the first display unit 120 to receive a user's input.

The first display unit 120 displays thereon the set charging standards. The first display unit 120 may include a thin film transistor-liquid crystal display (TFT-LCD) and a driver (not shown) to drive the TFT-LCD, for example.

The first display unit 120 may display whether to change the CPP according to the charge conditions for the CPP and receive a user's selection of the change.

The set charging standards are stored in the first storage unit 130.

The first storage unit 130 may include an internal or external storage module, such as a hard disc drive (HDD) and a flash memory. The first storage unit 130 of the image forming apparatus server 100 according to the present embodiment may further store therein authentication information to authenticate a user or administrator mode.

The first storage unit 130 may further store therein a charges calculation program, and usage volume information periodically collected from the image forming apparatuses 200-1, 200-2, . . . and **200-*n*** by an execution of the charges calculation program and change history of the charging standards.

The first communication unit 140 communicates with at least one of the image forming apparatuses 200-1, 200-2, . . . and **200-*n*** according to a predetermined protocol.

More specifically, the image forming apparatus server 100 may receive print usage volume information from at least one of the image forming apparatuses 200-1, 200-2, . . . and **200-*n* through the first communication unit 140**.

The image forming apparatus server 100 may consistently receive the print usage volume information while performing a data communication with at least one of the image forming apparatuses 200-1, 200-2, . . . and **200-*n* according to the predetermined protocol. The charges calculation program may consistently give a command requesting usage volume information to at least one of the image forming apparatuses 200-1, 200-2, . . . and 200-*n* to collect the usage volume information while the image forming apparatuses 200-1, 200-2, . . . and 200-*n* may transmit the print usage volume information to the image forming apparatus server 100** in response to the command.

The first communication unit 140 may include a wired/wireless communication module which is connected to an external device, such as the image forming apparatuses 200-1, 200-2, . . . and **200-*n* or the host apparatuses 300-1, 300-2, . . . and 300-*n*** by local connection or in a network by a predetermined protocol.

The first controller 150 controls the image forming apparatus server 100 as a whole. The first controller 150 may include software or firmware, such as the charges calculation program incorporated with hardware, such as a central processing unit (CPU).

Figure 2:
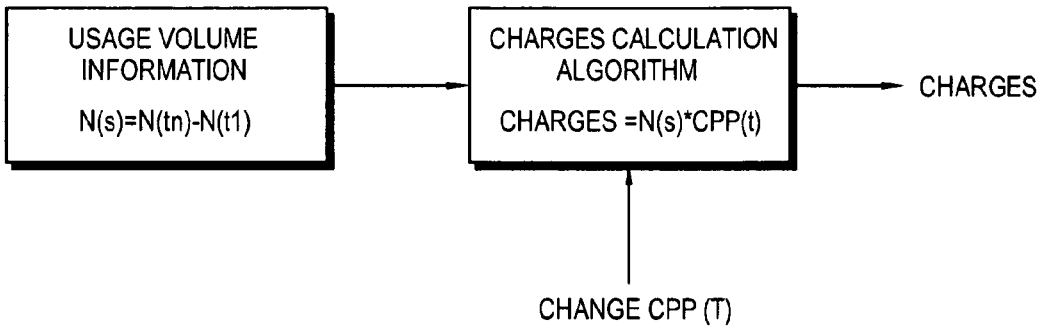
FIG. 2 illustrates an algorithm by which charges are calculated according to the exemplary embodiment.

FIG. 2 illustrates an algorithm by which the charges are calculated according to the exemplary embodiment.

As shown therein, the first controller 150 collects print usage volume information N(s) during the charging period according to the set charging standards.

The first controller 150 may collect the print usage volume information at set charging intervals (e.g., one month) through the first communication unit 140 or selectively obtain usage volume information N(t1), N(t2), . . . , and N(tn) corresponding to the charging period out of the usage volume information prestored in the first storage unit 130.

As shown therein, the usage volume information N(s) refers to the number of printed sheets of paper during the charging period, and may be determined by a following formula:

$$N(s)=N(tn)-N(t1)$$

Here, N(tn) refers to the number of printed sheets of paper on the last day of the charging period and N(t1) is the number of printed sheets of paper on the first day of the charging period.

The first controller 150 calculates the charges by using the collected usage volume information and CPP(t) according to the charges calculation algorithm by a following formula:

$$\text{Charges}=N(s)*\text{CPP}(t)$$

The first controller 150 may compare the usage volume during the charging period and the usage volume during the previous charging period and determine whether to change CPP(t).

The first controller 150 compares a print volume N(now) or N(n) during the concerned charging period and a print volume N(previous) or N(p) during the previous charging period and determines whether the print volume has increased or decreased. That is, the first controller 150 compares the value N(n−p) and a predetermined reference value (a, b) and a more specific algorithm is as follows.

1) If the print volume has increased:

If N(n−p)>a, choose CPP(case) reflecting increase in the volume or (1+N(n−p) (ratio))*CPP(i).

2) If the print volume has decreased:

If N(n−p)<b, choose CPP(case) reflecting decrease in the volume or (1−N(n−p)(ratio))-CPP(i).

CPP(i) is the current CPP value, and N(n−p)(ratio) is a change rate of the print volume, and the reference values a and b may be set as zero.

The reference values a and b may be set as the predetermined number of printed sheets of paper, e.g., a=+100 and b=−100. If N(n−p) is at least 100 sheets of paper, it may be determined that the print usage volume is changed.

The reference values a and b may be set as a predetermined rate (e.g., 10% increase in the usage volume (a=110%), 10% decrease in the usage volume (b=90%)) as the case may be.

The references values a and b may be preset as change requirements for the CPP and stored in the first storage unit 130 at the time of execution of the agreement between an administrator and a user.

The first controller 150 changes CPP(t) according to the comparison result of N(n−p) and the reference values a and b.

The first controller 150 may use absolute comparison and relative comparison in determining new CPP(i+1).

The absolute comparison increases or decreases CPP corresponding to the change rate of the print volume by a following formula:

$$CPP(i+1)=N(n-p)(\text{ratio})*CPP(i)$$

For example, if the current CPP (CPP(i)) is 100 won and the print volume increases by 10%, new CPP (CPP(i+1)) equals 110 won. Likewise, if the print volume increases by 13%, CPP (CPP(i+1)) equals 113 won.

The relative comparison increases or decreases CPP with reference to a preset table below, for example.

TABLE 1

| | Increase and decrease rate of print volume (%) | | | | | |
|---|---|---|---|---|---|---|
| | Less than 70% | 70% or more and less than 80% | 80% or more and less than 90% | 110% or more and less than 120% | 120% or more and less than 130% | 130% or more |
| CPP (case) | Amendment of agreement | 80 won | 90 won | 110 won | 120 won | amendment of agreement |

Referring to Table 1 above, if the current CPP(CPP(i)) is 100 won and the print volume increases by 10%, new CPP (CPP(i+1)) equals 110 won. If the print volume increases by 13%, CPP(CPP(i+1)) equals 110 won.

If there is a sharp increase or decrease in the print volume as in Table 1 (increase or decrease by 30% or more), the agreement executed between a supplier and a user may be amended and the CPP may be set again.

If the new CPP (CPP(i+1)) is determined, the first controller calculates the charges according to a following formula.

$$Charges=N(S)*CPP(i+1)$$

An administrator imposes the charges calculated during a charging period on a user.

The image forming apparatus server 100 according to the present embodiment compares the print usage volume during the concerned charging period and the previous print usage volume and uses the charges calculation algorithm reflecting the change to thereby reduce errors in the initial charging standards, actively respond to a changed user environment and win confidence from both a supplier and a user.

The image forming apparatuses 200-1, 200-2, . . . and **200-*n* receive print data from the host apparatuses 300-1, 300-2, . . . , and 300-*n*** and perform a print operation.

As shown in FIG. 1, the image forming apparatuses 200-1, 200-2, . . . and **200-*n* include a second storage unit 230 which stores therein usage volume information, a second communication unit 240 which communicates with the image forming apparatus server 100, a second controller 250 which controls the image forming apparatus as a whole and an image forming unit 260** which performs a print operation based on the received print data.

The image forming apparatuses 200-1, 200-2, . . . and **200-*n* according to the present embodiment periodically transmit print usage volume information to the image forming apparatus server 100**.

The second storage unit 230 stores therein print data and print usage volume information received from the host apparatuses 300-1, 300-2, . . . , and **300-*n*** and includes an internal storage medium, such as an HDD, or an external or portable storage medium, such as a USB memory, a memory card (memory stick, CF card and MMC) or a memory card slot.

The second communication unit 240 performs a data communication with the outside including the image forming apparatus server 100 and the host apparatuses 300-1, 300-2, . . . , and **300-*n***, receives print data in a predetermined print language from the outside or transmits print usage volume information to the outside.

The second communication unit 240 may include a wired/wireless communication module which is connected by a local connection or in a network by a predetermined protocol with an external device, such as the image forming apparatus server 100 and the host apparatuses 300-1, 300-2, . . . , and **300-*n*** or include a USB port which is connected to a portable storage medium, such as a USB memory stick.

The second controller 250 counts and stores the number of printed sheets of paper in the second storage unit 230, and transmits the stored print usage volume information to the image forming apparatus server 100 according to a request from the image forming apparatus server 100.

In the printing system 10 with the foregoing configuration, a print charging process of the image forming apparatus server 100 will be described with reference to FIG. 3.

Figure 3:
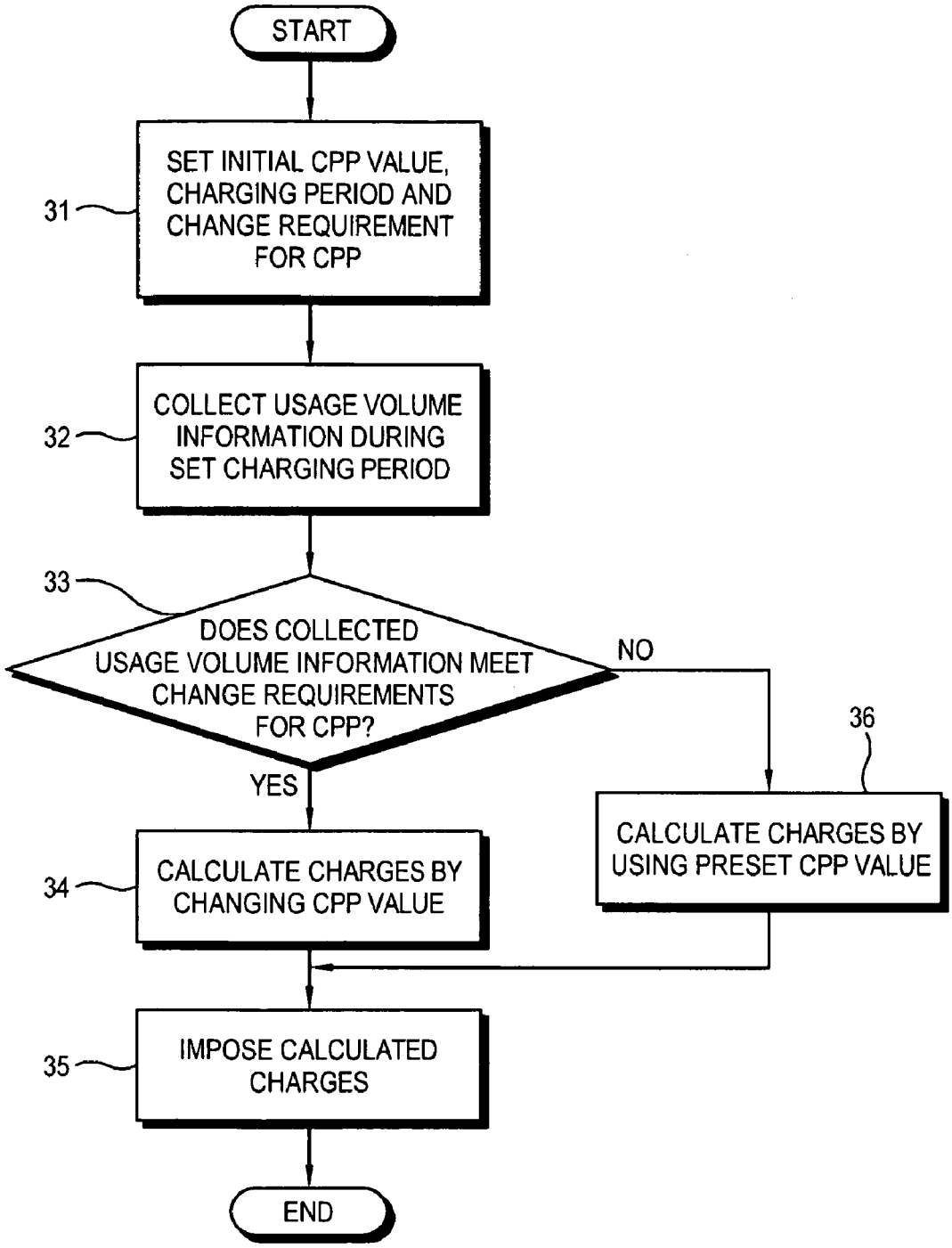
FIG. 3 is a flowchart which illustrates a print charging method of the image forming apparatus server according to the present embodiment.

FIG. 3 is a flowchart which illustrates a print charging method of the image forming apparatus server 100 according to the present embodiment.

As shown therein, an equipment supplier (i.e., administrator) and a user may set the CPP, the charging period and the change requirements for the CPP as charging standards under the lease agreement (31).

The first controller 150 collects the usage volume information during the charging period set at operation 31 from at least one of the image forming apparatuses 200-1, 200-2, . . . and **200-*n* (32). The charging period may be set at predetermined intervals, and the first controller 150 may determine the usage volume information during the charging period by subtracting the number of printed sheets of paper (N(t1**)) on the first day of the period from the number of printed sheets of paper (N(tn)) on the last day of the period.

The first controller 150 determines whether the usage volume information collected at operation 32 meets the CPP change requirements and determines whether to change the CPP (33). The first controller 150 may compare the print volume during the concerned charging period and the print volume during the previous charging period, and compare the change volume and the predetermined reference value to determine change of the CPP.

If the change requirements for the CPP are met at operation 33, the first controller 150 changes the CPP and calculates the charges (34). The first controller 150 may change the CPP to have the print volume during the charging period determined at operation 33 correspond to the print volume during the previous charging period or change the CPP by using the prestored table corresponding to the change rate. The first controller 150 calculates the charges by using the changed CPP and the charging period.

An administrator imposes the charges calculated at operation 34 on a user (35).

If the change requirements for the CPP are not met at operation 33, the first controller 150 calculates the charges by using the preset CPP which has been used for the previous charging period (36).

An administrator imposes the charges calculated at operation 36 on a user (35).

According to the exemplary embodiment, the image forming apparatus server 100 according to the present embodiment compares the print usage volume during the concerned charging period and the previous print usage volume by using the charges calculation program in accordance with the predetermined algorithm, and uses the changed CPP reflecting the change to thereby reduce errors in the initial charging standards, actively respond to the changed user environment and win confidence from both a supplier and a user.

As described above, an image forming apparatus server connected to an image forming apparatus and a print charging method thereof according to the present embodiment collects user's print usage volume at predetermined intervals and calculates charges by changing charging standards depending on the collected usage volume information to thereby reduce errors in the initial charging standards and win confidence from both a supplier and a user.

Although a few exemplary embodiments have been shown and described, it will be appreciated by those skilled in the art that changes may be made in these exemplary embodiments without departing from the principles and spirit of the invention, the scope of which is defined in the appended claims and their equivalents.

What is claimed is:

1. A print charging method for at least one image forming apparatus, the method comprising:

setting charging standards for the at least one image forming apparatus;

collecting usage volume information of the at least one image forming apparatus according to the set charging standards;

changing the charging standards by using the collected usage volume information and calculating charges by using the changed charging standards; and determining whether to change the charging standards by using a change rate of a usage volume collected during a predetermined charging period with respect to a usage volume collected during a previous charging period.

2. The method according to claim 1, further comprising determining whether to change the charging standards by using the collected usage volume information.

3. The method according to claim 1, wherein the charging standards comprise a charging period, and the collecting the usage volume information comprises collecting usage volume information during the set charging period.

4. The method according to claim 3, wherein the charging standards further comprise a cost per page (CPP) and change requirements for the CPP.

5. The method according to claim 4, wherein an initial value of the CPP is set according to at least one of equipment costs, a lease period, a charging period, an estimated usage volume, supplies expenses, a discount rate and service charges.

6. The method according to claim 4, wherein the calculating the charges comprises calculating the charges by using the usage volume information during the set charging period and the CPP.

7. The method according to claim 4, wherein the determining whether to change the charging standards further comprises comparing the change rate and a predetermined reference value, and determining whether to change the charging standards according to the comparison result.

8. The method according to claim 4, wherein the calculating the charges comprises calculating the charges by increasing or decreasing the CPP corresponding to the change rate.

9. The method according to claim 4, wherein when the change rate is greater than a first reference change rate or less than a second reference change rate, the CPP is not increased or decreased corresponding to the change rate and the CPP is reset.

10. The method according to claim 4, further comprising storing a table including the CPP corresponding to the change rate, wherein the calculating the charges comprises calculating the charges by using the stored CPP corresponding to the change rate.

11. The method according to claim 4, wherein the calculating the charges comprises changing the CPP to have the usage volume during the predetermined charging period correspond to the usage volume during the previous charging period.

12. An image forming apparatus server connected to at least one image forming apparatus, the image forming apparatus server comprising:

a user input unit to set charging standards for the at least one image forming apparatus;

a communication unit to collect usage volume information of the at least one image forming apparatus;

a storage unit to store therein the collected usage volume information; and a controller to control the communication unit to collect the usage volume information according to the set charging standards and to change the charging standards by using the usage volume information, calculate charges by using the changed charging standards, and determine whether to change the charging standards by using a change rate of a usage volume collected during a predetermined charging period with respect to a usage volume collected during a previous charging period.

13. The image forming apparatus server according to claim 12, wherein the controller determines whether to change the charging standards by using the stored usage volume information.

14. The image forming apparatus server according to claim 12, wherein the charging standards comprise a charging period and the communication unit collects usage volume information during the set charging period.

15. The image forming apparatus server according to claim 14, wherein the charging standards further comprise a cost per page (CPP) and a change requirements for the CPP.

16. The image forming apparatus server according to claim 15, wherein an initial value of the CPP is set according to at least one of an equipment cost, a lease period, a charging period, an estimated usage volume, supplies expenses, a discount rate and service charges.

17. The image forming apparatus server according to claim 15, wherein the controller calculates the charges by using the usage volume information during the set charging period and the CPP.

18. The image forming apparatus server according to claim 15, wherein the controller compares the change rate and a predetermined reference value and determines whether to change the charging standards according to the comparison result.

19. The image forming apparatus server according to claim 15, wherein the controller calculates the charges by increasing or decreasing the CPP corresponding to the change rate.

20. The image forming apparatus server according to claim 15, wherein the storage unit further stores therein a table including the CPP corresponding to the change rate, and the controller calculates the charges by using the CPP corresponding to the change rate.

* * * * *

UNITED STATES PATENT AND TRADEMARK OFFICE

CERTIFICATE OF CORRECTION

PATENT NO. : 8,364,053 B2
APPLICATION NO. : 12/801223
DATED : January 29, 2013
INVENTOR(S) : Jae-kyung Cho It is certified that error appears in the above-identified patent and that said Letters Patent is hereby corrected as shown below:

In the Claims:

Column 10, Line 5, In Claim 7, delete “claim 4,” and insert -- claim 1, --, therefor.
Column 10, Line 35, In Claim 12, after “information;” delete “and”.

Signed and Sealed this
Twenty-eighth Day of May, 2013

Teresa Stanek Rea
*Acting Director of the United States Patent and Trademark Office*